US007111746B2

(12) United States Patent
Miceli et al.

(10) Patent No.: US 7,111,746 B2
(45) Date of Patent: Sep. 26, 2006

(54) SHELLABLE CHILD RESISTANT CLOSURE CONTAINER WITH POSITIVE LOCK MECHANISM

(75) Inventors: David A. Miceli, Reno, NV (US); Joseph Miceli, Spencer, TN (US)

(73) Assignee: Tri State Distribution, Inc., Spencer, TN (US)

( * ) Notice: Subject to any disclaimer, the term of this patent is extended or adjusted under 35 U.S.C. 154(b) by 28 days.

(21) Appl. No.: 10/753,971

(22) Filed: Jan. 8, 2004

(65) Prior Publication Data

US 2004/0195197 A1 Oct. 7, 2004

Related U.S. Application Data

(60) Provisional application No. 60/438,521, filed on Jan. 8, 2003.

(51) Int. Cl.
*B65D 55/02* (2006.01)

(52) U.S. Cl. ..... 215/219; 215/228

(58) Field of Classification Search ..... 215/209–228, 215/230, 330, 331
See application file for complete search history.

(56) References Cited

U.S. PATENT DOCUMENTS

| | | | | |
|---|---|---|---|---|
| 942,141 | A | 12/1909 | Hoffman | |
| 1,435,723 | A | 11/1922 | Mayer | |
| 2,054,031 | A | 9/1936 | Conner et al. | 215/7 |
| 3,344,942 | A | 10/1967 | Hedgewick | 215/9 |
| 3,399,796 | A | 9/1968 | Steiner | 215/9 |
| 3,435,975 | A | 4/1969 | Weigand | 215/9 |
| 3,445,022 | A | 5/1969 | Cilluffo | 215/9 |
| 3,557,985 | A | 1/1971 | St. Denis | 215/9 |
| 3,612,324 | A | 10/1971 | Malick | 215/9 |
| 3,627,160 | A | 12/1971 | Horvath et al. | 215/9 |
| 3,669,295 | A | 6/1972 | Horvath | 215/9 |
| 3,690,495 | A | 9/1972 | Turner | 215/9 |
| 3,782,574 | A | 1/1974 | Rumle | 215/9 |
| 3,795,338 | A | 3/1974 | Swartzbaugh et al. | 215/9 |
| 3,797,688 | A * | 3/1974 | Porcelli et al. | 215/220 |
| 3,812,989 | A | 5/1974 | Horvath | 215/9 |
| 3,830,391 | A | 8/1974 | Uhlig | 215/9 |
| 3,836,034 | A | 9/1974 | Lecinski, Jr. | 215/9 |

(Continued)

FOREIGN PATENT DOCUMENTS

| | | |
|---|---|---|
| DE | 25 33 230 | 2/1977 |

(Continued)

OTHER PUBLICATIONS

International Search Report, PCT/US01/06103, Feb. 27, 2001.
Written Opinion PCT/US01/06103, Jan. 22, 2002.

*Primary Examiner*—Lien M. Ngo
(74) *Attorney, Agent, or Firm*—Waddey & Patterson, P.C.; Phillip E. Walker; I. C. Waddey, Jr.

(57) ABSTRACT

A shellable, positively lockable, child resistant closure and container includes a pair of nested inner and outer caps designed to be purposefully shellable for use in its non-child resistant mode. The inner cap is coaxially positioned and nested within the outer cap such that a row of angular abutments of the inner cap engage a row of angular abutments of the outer cap upon rotation of the outer cap in a closing direction, and upon rotation of the outer cap in an opening direction, without a concomitant axial force, the respective angular abutments cam over and past each other to prevent rotation of the inner cap. Additionally, the inner cap contains a positive locking device for engagement with a complementary locking device on the neck of the container.

24 Claims, 5 Drawing Sheets

U.S. PATENT DOCUMENTS

| | | | | | |
|---|---|---|---|---|---|
| 3,865,267 | A | | 2/1975 | Morris | 215/206 |
| 3,871,662 | A | | 3/1975 | Hepp et al. | 215/223 |
| 3,894,647 | A | | 7/1975 | Montgomery | 215/9 |
| 3,907,145 | A | | 9/1975 | Horvath | 215/206 |
| 3,951,289 | A | | 4/1976 | Landen | 215/211 |
| 4,006,836 | A | | 2/1977 | Micallef | 215/218 |
| 4,011,829 | A | | 3/1977 | Wachsmann et al. | 116/121 |
| 4,011,960 | A | | 3/1977 | Mauvernay et al. | 215/220 |
| 4,071,156 | A | | 1/1978 | Lowe | 215/224 |
| 4,087,016 | A | | 5/1978 | Towns et al. | 215/211 |
| 4,095,718 | A | | 6/1978 | Kong | 215/223 |
| 4,103,797 | A | | 8/1978 | Morris | 215/209 |
| 4,105,132 | A | | 8/1978 | Keeler | 215/216 |
| 4,117,945 | A | | 10/1978 | Mumford | 215/216 |
| 4,223,793 | A | | 9/1980 | Patton | 215/220 |
| 4,223,794 | A | | 9/1980 | Morris | 215/220 |
| 4,271,971 | A | | 6/1981 | Morris | 215/220 |
| 4,271,974 | A | * | 6/1981 | Quinard | 215/331 |
| 4,281,771 | A | | 8/1981 | Siegel | 215/220 |
| 4,285,437 | A | | 8/1981 | Morris | 215/220 |
| 4,334,638 | A | | 6/1982 | Stock | 222/153 |
| 4,346,809 | A | | 8/1982 | Kusz | 215/214 |
| 4,375,859 | A | | 3/1983 | Fillmore | 215/223 |
| 4,387,821 | A | | 6/1983 | Geiger | 215/330 |
| 4,406,376 | A | | 9/1983 | Berghahn | 215/224 |
| 4,413,742 | A | | 11/1983 | Sandhaus | 215/216 |
| 4,433,789 | A | | 2/1984 | Gibilisen | 215/220 |
| 4,452,364 | A | * | 6/1984 | Kay | 215/253 |
| 4,469,233 | A | | 9/1984 | Wegscheid | 215/230 |
| 4,500,005 | A | | 2/1985 | Forrester | 215/203 |
| 4,511,051 | A | | 4/1985 | Desai | 215/225 |
| 4,520,938 | A | | 6/1985 | Finke | 215/220 |
| 4,526,281 | A | | 7/1985 | Herr | 215/211 |
| 4,553,678 | A | | 11/1985 | Thorsakken | 215/218 |
| 4,613,051 | A | | 9/1986 | Swartzbaugh | 215/225 |
| 4,669,620 | A | | 6/1987 | Coifman | 215/220 |
| 4,676,388 | A | | 6/1987 | Kuboshima | 215/217 |
| 4,687,112 | A | | 8/1987 | Swartzbaugh | 215/216 |
| 4,694,968 | A | | 9/1987 | Proctor et al. | 215/224 |
| 4,729,487 | A | | 3/1988 | Wright | 215/220 |
| 4,752,013 | A | | 6/1988 | Miller et al. | 215/216 |
| 4,752,014 | A | | 6/1988 | House et al. | 215/216 |
| 4,790,444 | A | | 12/1988 | Terzi | 220/90.2 |
| 4,799,579 | A | * | 1/1989 | Myers et al. | 192/107 M |
| 4,823,967 | A | | 4/1989 | Thompson | 215/222 |
| 4,832,218 | A | | 5/1989 | Gibilisco | 215/220 |
| 4,854,459 | A | | 8/1989 | DeJonge | 215/220 |
| 4,913,299 | A | * | 4/1990 | Petro | 215/330 |
| 4,991,729 | A | | 2/1991 | Hunter | 215/206 |
| 4,998,632 | A | | 3/1991 | Morris, Sr. | 215/201 |
| D316,039 | S | | 4/1991 | Sykes et al. | 9/436 |
| 5,092,477 | A | * | 3/1992 | Johnson et al. | 215/230 |
| 5,115,928 | A | | 5/1992 | Drummond, Jr. | 215/219 |
| D329,809 | S | | 9/1992 | Bloomfield | 9/443 |
| 5,148,931 | A | * | 9/1992 | Minh | 215/220 |
| 5,190,178 | A | | 3/1993 | Luch | 215/256 |
| 5,197,616 | A | | 3/1993 | Buono | 215/220 |
| 5,234,118 | A | | 8/1993 | Fillmore et al. | 215/220 |
| 5,246,123 | A | | 9/1993 | Kramer et al. | 215/220 |
| 5,280,842 | A | | 1/1994 | Koo | 215/220 |
| 5,317,796 | A | | 6/1994 | Hunter | 29/434 |
| 5,372,267 | A | | 12/1994 | Hofmann | 215/220 |
| 5,449,077 | A | | 9/1995 | Seidler | 215/216 |
| 5,449,078 | A | | 9/1995 | Akers | 215/222 |
| 5,460,281 | A | | 10/1995 | Rapchak et al. | 215/216 |
| 5,464,110 | A | | 11/1995 | Heyworth | 215/223 |
| D374,821 | S | | 10/1996 | Johnson | 9/447 |
| 5,579,933 | A | | 12/1996 | Hofmann | 215/220 |
| 5,579,934 | A | | 12/1996 | Boono | 215/230 |
| 5,603,421 | A | | 2/1997 | Opresco | 215/217 |
| 5,636,756 | A | | 6/1997 | Johnson | 215/206 |
| 5,671,853 | A | | 9/1997 | Berr | 215/216 |
| 5,687,863 | A | | 11/1997 | Kusz | 215/216 |
| 5,706,963 | A | | 1/1998 | Gargione | 215/219 |
| 5,711,442 | A | | 1/1998 | Kusz | 215/209 |
| 5,722,546 | A | | 3/1998 | Briere | 215/216 |
| 5,769,252 | A | | 6/1998 | Volpe | 215/221 |
| 5,791,515 | A | | 8/1998 | Khan et al. | 221/154 |
| D399,743 | S | | 10/1998 | Coon et al. | 9/443 |
| 5,819,967 | A | | 10/1998 | Lo | 215/206 |
| 5,819,968 | A | | 10/1998 | Jones | 215/222 |
| 5,836,465 | A | | 11/1998 | King | 215/216 |
| 5,865,330 | A | | 2/1999 | Buono | 215/216 |
| 5,889,348 | A | | 3/1999 | Muhlberger et al. | 310/218 |
| 5,924,588 | A | | 7/1999 | Brennan | 220/23.8 |
| 5,927,532 | A | | 7/1999 | Traub | 215/342 |
| 5,934,492 | A | | 8/1999 | Jones | 215/222 |
| 5,988,413 | A | | 11/1999 | Nagel | 215/216 |
| 6,082,565 | A | | 7/2000 | Harrold | 215/218 |
| 6,446,823 | B1 | | 9/2002 | Miceli et al. | 215/228 |
| 6,508,373 | B1 | * | 1/2003 | Robinson | 215/209 |
| 6,523,709 | B1 | | 2/2003 | Miceli et al. | 215/228 |

FOREIGN PATENT DOCUMENTS

| | | |
|---|---|---|
| DE | 29 27 339 A1 | 1/1981 |
| EP | 0 792 818 A1 | 3/1997 |
| FR | 2 471 329 | 6/1981 |
| GB | 2 030 970 A | 4/1980 |
| GB | 2 137 601 A | 10/1984 |
| GB | 2 182 649 | 5/1987 |
| WO | WO 90/04546 | 5/1990 |
| WO | WO 01/64529 A2 | 9/2001 |

* cited by examiner

SHELLABLE CHILD RESISTANT CLOSURE CONTAINER WITH POSITIVE LOCK MECHANISM

CROSS-REFERENCES TO RELATED APPLICATIONS

This Application is a Utility application which claims benefit of co-pending U.S. Patent Application Ser. No. 60,438,521 filed Jan. 8, 2003, entitled "Shellable Child Resistant Closure Container with Positive Lock Mechanism" which is hereby incorporated by reference.

FIELD OF INVENTION

The present invention is directed to a child resistant closure and container and more particularly to a child resistant closure and container designed to be optionally shellable to convert it to its non-child resistant mode. In its child resistant mode, this invention relates to a dual cap design that provides an obstacle to those with limited hand strength, including and especially children, being able to remove the closure from the container. In either configuration, the closure and container assembly present a positive lock mechanism designed to provide an affirmative indication that full closure has been attained.

BACKGROUND OF THE INVENTION

There are many types of child resistant closure systems described in the art. An example of a particular type of child resistant closure system is proposed in U.S. Pat. No. 5,449,078, which relates to a combination of a container and safety cap. While many child resistant caps effectively provide protection against the danger of small children being able to remove potentially harmful contents, e.g. pills, from vials or other containers, they also provide a problem for a considerable portion of the adult population that require medication but lack the manual dexterity or strength to remove the child resistant cap. This is of a particular concern to the elderly population or people suffering from arthritis and other disabling diseases.

This particular problem has been addressed by the development of closure systems having a child resistant mode and a non-child resistant mode such that, in the non-child resistant mode, the closures are more easily opened by adults. Another example of such a closure is disclosed in U.S. Pat. No. 5,579,934, (the '934 patent). The '934 patent proposes a container closure that is selectively manipulatable between a configuration which resists opening by children and a configuration which may be easily opened without special manipulation of the closure. Specifically, the closure is manipulated into its non-child resistant mode by "pressing down" on the central portion of the top surface of the closure. Although the aforementioned closure provides an advance in the art of protection against the danger of small children being able to remove it from vials or other containers, a certain portion of the adult population lack the manual dexterity or strength to "press down" the central portion of the top surface of the closure so as to manipulate the closure from its child resistant configuration to its non-child resistant configuration. This manipulation or "pushing down" also represents a problem for people with long fingernails.

Other reversible or convertible child resistant closures have been proposed to address this problem. But making the closure easier to convert into the non-child resistant configuration increases the risk that the closures will inadvertently be converted into their non-child resistant configurations. Similarly, there is an increased risk that automated filling machines will inadvertently convert the closures into their non-child resistant configurations when applying the closure to the container.

Further, the closures of the type disclosed in the '934 patent cannot include a warning to the consumer once the closure has been converted to its non-child resistant configuration. This message is required by the Consumer Product Safety Commission ("CPSC") to alert users that the closure has been converted into the non-child resistant configuration. Also, other reversible child resistant designs that do include the CPSC consumer warning cannot be used in automated dispensing equipment due to projections on their outer surface.

One problem in the art which is of particular concern is that where, out of inadvertence or neglect, a child resistant closure becomes partially closed, the child-resistant mechanism is not fully operative to the point that the child resistant container becomes susceptible to opening by children. One solution to this problem is to incorporate a positive lock mechanism or indicator to ensure that the child resistant mode is fully engaged whenever it is desired to do so.

Furthermore, in child resistant caps including two or more cap elements such as an inner cap element nested within an outer cap element equipped with an engaging device for rotatably coupling one cap element to the other, such as proposed in U.S. Pat. No. 4,520,938, the inventors herein have observed that where the outer cap is made of resilient material such as plastic, a risk exists that children could separate one cap from the other ("shelling") thereby disabling the child resistance mode of operation. Once shelled, there is usually no other safeguard to prevent access to the contents of the container.

That is not to say, however, that purposeful shelling of a child resistant cap is undesirable. Indeed, it is also commercially desirable to have a child resistant cap assembly where the child-resistant means is incorporated only at the option of the consumer. One way to achieve this is to design a cap that is readily shellable by a person knowledgeable of how to easily shell the cap and which, when shelled, operates only in the non-child resistant position. In that way the outer shell or cap may also constitute a separate commercial item that can be used to convert an otherwise non-child resistant cap to a child-resistant cap.

In light of the foregoing, there is need for a closure and a container system that has a child resistant mode, has a non-child resistant mode which may be easily opened without special manipulation once a minimal torque threshold has been overcome, incorporates a positive lock mechanism to ensure that the child resistant mode is fully engaged, resists inadvertent conversion from its child resistant mode to its non-child resistant mode and still provides a fall back safeguard where that has been done, is capable of including the mandated CPSC warning "CAUTION NOT CHILD RESISTANT" when used in its non-child resistant mode, and can be used in automated dispensing machines thereby addressing the aforementioned deficiencies of the prior art.

BRIEF SUMMARY OF THE INVENTION

The present invention is directed to a closure that can substantially obviate one or more of the problems due to limitations and disadvantages of the related art. Additional features and advantages of the invention will be set forth in the description which follows, and in part will be apparent from the description, or may be learned by practice of the invention. The objectives and other advantages of the invention will be realized and attained by the apparatus particularly pointed out in the written description and claims hereof as well as in the appended drawings.

BRIEF DESCRIPTION OF THE SEVERAL VIEWS OF THE DRAWINGS

In the drawings, wherein like reference numerals identify similar elements throughout several views.

DETAILED DESCRIPTION OF THE INVENTION

Figure 1A:
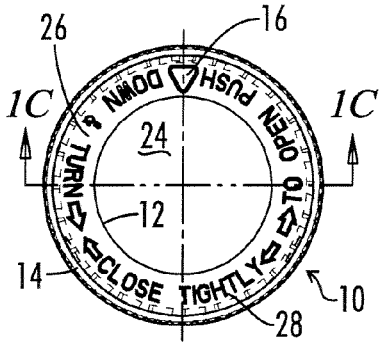
FIG. 1A illustrates a top view of the outer cap.
Figure 1B:
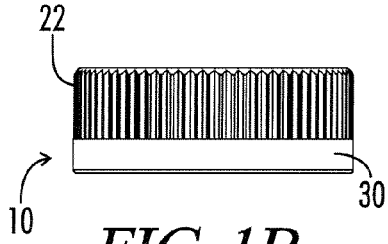
FIG. 1B illustrates a side view of the outer cap.

Shellable child resistant closures of the present invention are preferably for use with a container having a neck portion with an engaging device and an axis extending therethrough about which the closure is rotatable. The closure incorporates a dual cap design having an outer cap and an inner cap substantially nested within the outer cap and designed in such a way that the outer cap can be purposefully shelled. When shelled, the child resistant mechanism is disabled, allowing the closure to operate as a one-piece, non-child resistant cap. Thus, one aspect of the present invention is the provision of a low-cost, one-piece, non-child resistant cap that can be converted, at the option of the purchaser, to a two-piece child resistant cap.

Another aspect of the invention is provision of a closure having concentric inner and outer caps, the inner cap having a notch formed in a bottom portion of the inner cap for edgewise locking engagement with a laterally deflectable tab affixed on a flange proximate to the neck of the container. Alternatively, an axially or laterally deflectable tab on the bottom portion of the inner cap may be provided for edgewise locking engagement with a notch cut on a flange proximate to the neck of the container.

Another aspect of the present invention is provision of a shellable child resistant cap with a positive locking mechanism that imposes a minimal torque threshold for disengagement, thereby serving both as a complete closure indicator and a secondary barrier to disengagement, especially in cases where the child resistant mode has failed.

In accordance with an exemplary embodiment of the present invention, a child resistant closure and container assembly includes an externally threaded neck portion of the container defining an opening and includes a raised bead or flange at the bottom of the neck for affixing a tab or notch for locking engagement with a corresponding notch or tab on the inner cap member of the closure; and the shellable closure includes an outer cap and an inner cap.

Another aspect of the present invention is that the outer cap has an open top wall having an outer edge and an inner edge, a visual and/or tactile alignment marker formed on the top wall, a circumferential sidewall depending from the outer edge of the top wall having an inner and outer surface, a row of angular, e.g., saw-toothed, abutments disposed at the interior corner of the top wall and the side wall for slidable engagement with complementary angular abutments on the inner cap. The inner surface of the circumferential sidewall of the outer cap has at least one tapered tab projecting therefrom for engagement with and retention by a circumferential groove on the inner cap and spaced therefrom so that the tapered tab is movable radially and axially within the tapered circumferential groove of the inner cap. Alternatively, these two structures can be swapped, the groove being formed on inner surface of the outer cap, and the tab formed on the outer surface of the inner cap.

Another aspect of the present invention is that the inner cap has a closed top wall with a second visual and/or tactile alignment marker formed thereon, and a first circumferential sidewall depending from the top wall. The first circumferential sidewall has a top and bottom edge, a threaded inner surface for rotatable engagement with externally threaded neck of the container, and an outer surface including a row of radially disposed angular, e.g. saw-toothed, abutments at its top edge for selective rotatable engagement with the complementary angular abutments on the outer cap. The outer surface of the first circumferential sidewall of the inner cap further has at least one tapered circumferential groove for engaging and retaining the at least one tapered tab on the outer cap, and laterally disposed shelling channels for receiving the tapered tab to permit purposeful shelling of the outer cap from the inner cap of the closure when the first and second alignment markers are aligned. Also, depending from the bottom edge of the first circumferential sidewall of the inner cap is a second circumferential sidewall. The second circumferential sidewall of the inner cap is not exposed and is nested within the outer cap, and has laterally displaceable notches or tabs for positive locking engagement with corresponding tabs or notches on the flange at the neck of the container.

It is to be understood that both the foregoing general description and the following detailed description are exemplary and explanatory and are intended to provide further explanation of the invention as claimed. Other aspects and features of the invention will become apparent from the following detailed description considered in conjunction with the accompanying drawings. The accompanying drawings are included solely for purposes of illustration and not as a definition of the limits of the invention. Also, the drawings are not drawn to scale, and are merely conceptual in disclosing the preferred embodiments of the invention.

Figure 3A:
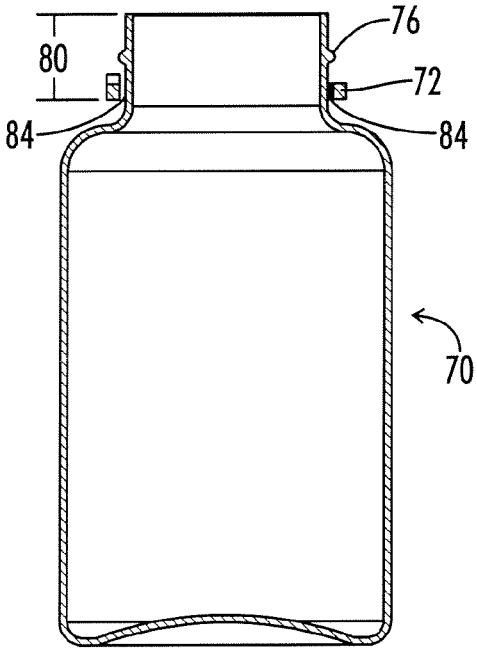
FIG. 3A illustrates a sectional view of the container.
Figure 3B:
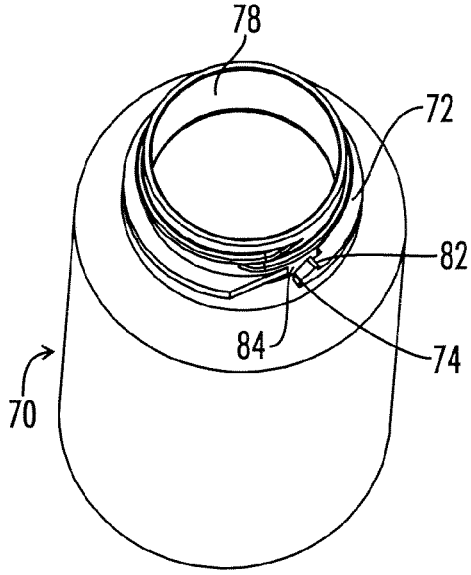
FIG. 3B illustrates a top and side perspective view of the container.
Figure 3C:
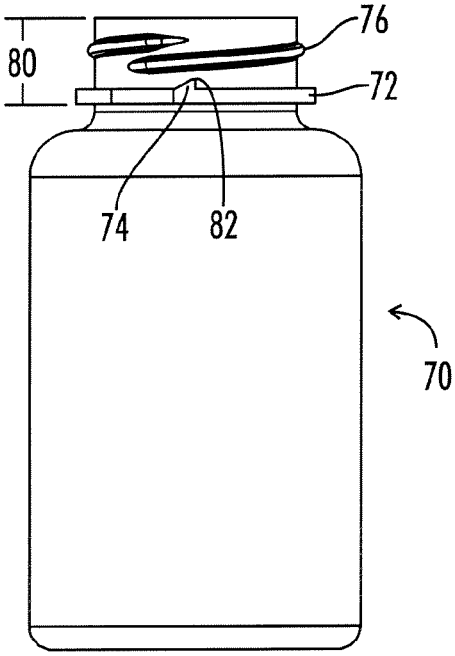
FIG. 3C illustrates a side view of the container.
Figure 4A:
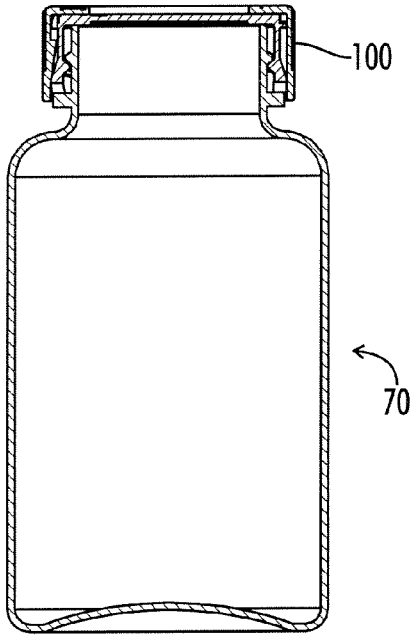
FIG. 4A illustrates a sectional view of the closure and container assembly.
Figure 4B:
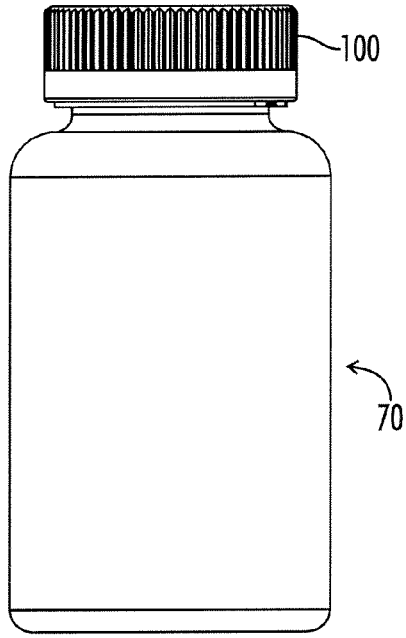
FIG. 4B illustrates a side view of the closure and container assembly.
Figure 4C:
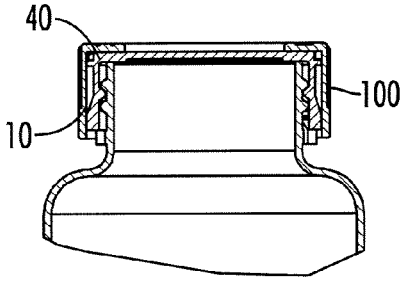
FIG. 4C illustrates a sectional view of the neck of the closure and container assembly.
Figure 4D:
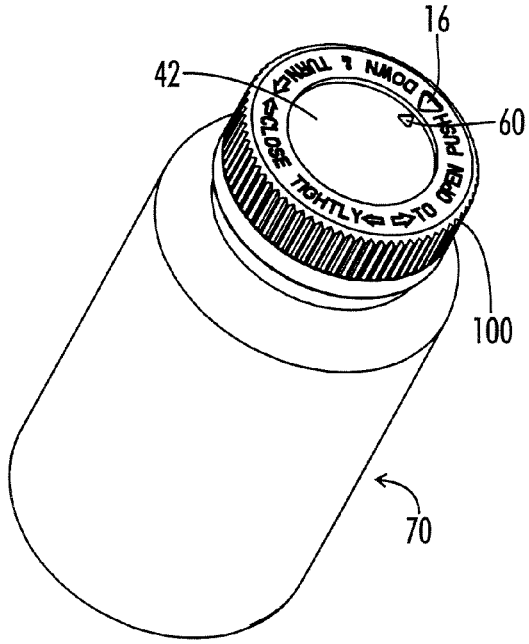
FIG. 4D illustrates a side and top perspective view of the closure and container assembly.

Referring now to the drawings of the present disclosure, in which like numbers represent the same or similar structures in the various views, FIGS. 4B and 4D show a shellable child resistant container and closure with positive lock mechanism in accordance with an exemplary embodiment of present invention, in its child resistant mode. The closure system includes a reversible child resistant closure 100 and a container 70. The closure 100 includes an outer cap 10 and an inner cap 40. The closure 100 is constructed for use with a container 70 having any suitable engaging devices, for example, an externally threaded neck portion 80 (see FIGS. 3A–3C), and is preferably for use with containers which store and dispense pharmaceutical products and the like, but may also be used with any container having a suitable engaging device, irrespective of its contents. As will be described in more detail below, the inner cap 40 is coaxially positioned and nested within the outer cap 10 such that it is movable within the outer cap 40 by a distance defined by the difference between the lateral length of tapered outer cap retaining tabs 18 and the length of a tapered radial groove 56 of the inner cap 40.

Figure 3D:
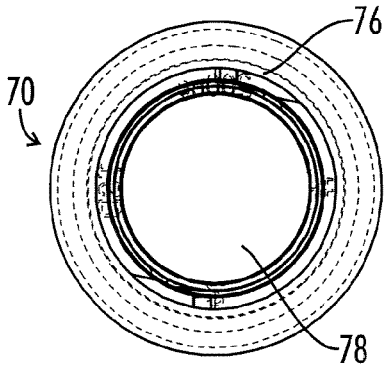
FIG. 3D is a top view of the container.

Referring to FIGS. 2A, 2B, 2C and 2D, the inner cap 40 includes a closed top wall 42 having a shelling alignment marker 60. Depending from the top wall 42 is a first circumferential side wall 46 having a top edge 64 and a bottom edge 66 and includes an engaging device on its inner surface, such as a threaded inner surface 62 for rotatable engagement with a mating engaging device 76 of the externally threaded neck 80 of the container 70 (see FIG. 3C). Any suitable engaging device for rotatable engagement may be used as will be readily apparent to those of skill in the art. For example, the engaging devices may include a thread bead for engaging the threaded exterior neck portion 80 of the container 70 shown in FIG. 3D. Preferably, the engaging device includes a single continuously threaded bead.

Figure 1C:
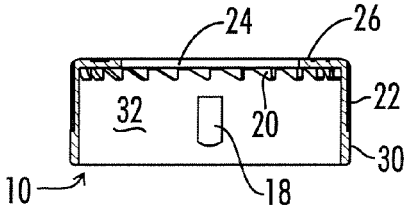
FIG. 1C illustrates a sectional view of the outer cap taken along the line C—C of FIG. 1A.

The outer surface 68 of the first circumferential sidewall 46 of the inner cap 40 has a row of angular, e.g., saw-toothed, abutments 44, circumferentially disposed at its top edge around the top wall 42 of the inner cap. These angular abutments 44 are of size, position, and orientation to complement the series of angular abutments for rotatable engagement with complementary angular abutments 20 of the outer cap 10 (see FIGS. 1C and 1E). Circumferentially disposed around the first circumferential side wall 46, e.g., at its midsection, is a tapered groove 56 shaped for nested engagement with and receiving the tapered retaining tabs 18 of the outer cap. The outer cap retaining tabs 18 are preferably designed to be engaged in the tapered groove 56 to allow for both an axial (up and down) and rotational movement of the outer cap around the inner cap, and especially around the inner cap when the closure is rotated in an opening direction, without the application of an axial force. Stated somewhat differently, the outer cap can rotate around the inner cap, with the tab(s) 18 riding in the groove 56, when an inadequate axial force is applied to move the caps toward each other, causing the complementary angular abutments of the inner and outer caps to can across each other.

Furthermore, laterally disposed on the outer surface of the first circumferential sidewall 46 is at least one shelling channel 52 designed to allow purposeful shelling of the outer cap from the inner cap. Preferably, one of the outer cap retaining tabs 18 is shaped to slide through the shelling channel 52 to ensure that separation of the outer cap from the inner cap is accomplished by only the purposeful hands of a person who has aligned the inner and outer caps properly.

When the shelling alignment marker 60 of the inner cap is aligned with the corresponding marker 16 of the outer cap, at least one of the outer cap retaining tabs 18 lines up with the shelling channel 52, and permit upward removal of the outer cap from the closure assembly. (See FIG. 4D).

Figure 4E:
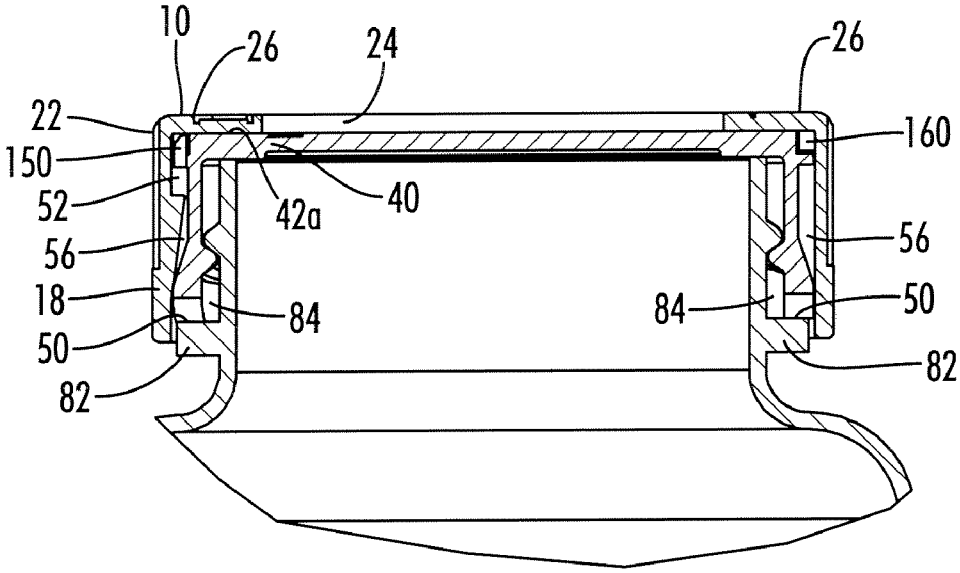
FIG. 4E illustrates portions of FIG. 4C at an enlarged scale.

Depending from the bottom edge 66 of the first circumferential sidewall 46 of the inner cap 10, is a second circumferential side wall 48. The second circumferential side wall 48 is preferably laterally or radially covered by adjacent portions of the outer cap 10 when the outer and inner cap members of the closure are assembled (see FIG. 4E). Different from prior configurations, however, the lower edge of the side wall 48 can optionally and preferably be left exposed, i.e., the outer cap 10 does not include any structure that wraps around this surface. This permits this lower edge to include a portion of the positive locking mechanism, described elsewhere herein, without interference or obstruction by the outer cap. The second circumferential sidewall bears the positive locking device on the closure that mates with the corresponding device on the container. Preferably, at the bottom edge of the second circumferential sidewall 48, one or more notches 50 is formed for edgewise engagement with a corresponding number of laterally displaceable tabs 74 affixed on the flange 72 of the neck 80 of the container 70 (see FIGS. 3A, 3B and 3C). Both the notches 50 and the tabs 74 are part of a positive lock mechanism of an exemplary embodiment of the present invention. In another embodiment of the invention, laterally displaceable tabs affixed on the bottom edge of the second circumferential wall 48 of the inner cap 40 are designed for edgewise engagement with corresponding notches on the flange 72 of the neck 80 of the container 70, i.e., the elements are reversed.

Referring now to FIGS. 1A, 1B, 1C, and 1D, an exemplary outer cap member of the child resistant closure has an open top wall 26 that has an inner edge 12, an outer edge 14, and a center opening 24. Printed or molded on the top wall 16 is at least one shelling alignment marker 16 for alignment with the corresponding alignment marker 60 of the inner cap 40. (See FIG. 2D). Depending from the outer edge 14 of the outer cap top wall 26 is a circumferential sidewall 30 having an inner surface 32 and an outer surface 34. The outer surface 34 of the circumferential sidewall 30 may include suitable gripping elements, shown in the embodiments represented by FIGS. 1B and 1D as a series of knurlings 22. Radially disposed on the inner surface 32 of the circumferential sidewall 30, at the outer edge 14 of the open top wall 26, is a series of angular, e.g. saw-toothed, abutments 20 for rotatable engagement with the corresponding angular abutments 44 of the inner cap 40.

Figure 1E:
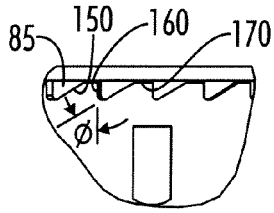
FIG. 1E illustrates a conceptual representation of a row of angular abutments on the interior edge of the outer cap.
Figure 1D:
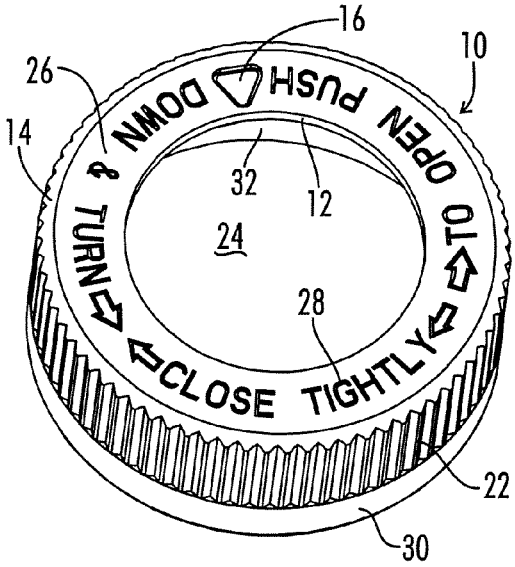
FIG. 1D illustrates a top and side perspective view of the outer cap.
Figure 1F:
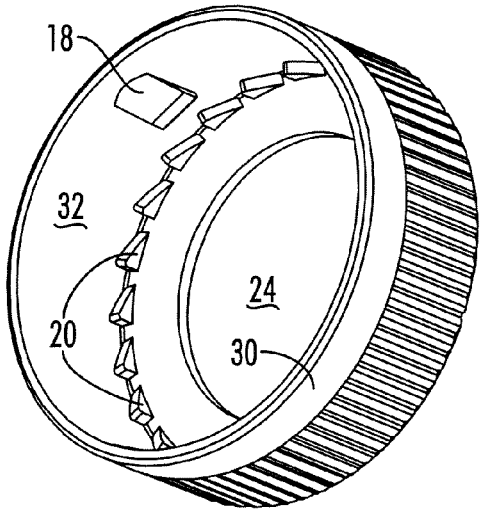
FIG. 1F illustrates a perspective view of the outer cap from the inside of the cap.

As shown in FIG. 1E, preferably the series of saw-toothed angular abutments extend downward from the top wall 26 and are radially offset from and parallel to the circumferential sidewall 30. Each tooth 85 forming the series of angular abutments of the outer cap 10 has a first sloped surface 150 and a second substantially vertical surface 160. The first sloped surface 150 and the second substantially vertical surface 160 define an angle Ø which is preferably in the range of from about 22° to about 45°, and is more preferably about 25° to about 33°. Each tooth may abut directly with the next, or may be spaced apart by surface 170. Preferably each tooth abuts directly with the next. Any suitable numbers of teeth may be utilized; however, preferably between twenty (20) and fifty (50) teeth 85 are included. Most preferably, the inner cap 40 includes about thirty six (36) individual teeth.

As already mentioned, projecting radially inwardly from the inner surface 32 of the circumferential sidewall 30 of the outer cap are at least one, and preferably a series, of tapered tabs 18 for engagement with the radial tapered groove 56 of the inner cap 40. Although a number of tabs may be used, two tabs, preferably disposed on diametrically opposite sides of the inner surface 32 of the circumferential sidewall 30 of the outer cap, are used. Alternatively, and we have now found to work best, three tabs 18 are equally spaced about the inner surface 32 of the circumferential sidewall 30 of the outer cap. These three tabs, in cooperation with the radial tapered groove 56, hold the outer cap in place over the inner cap. When one of the tabs is aligned with the shelling channel 52, some slight pressure against the bottom lip of the outer cap is necessary to shell the outer cap from its nesting relationship over the inner cap.

The outer cap retaining tabs 18 are dimensioned to fit through the shelling channel 52 of the inner cap 40. Each tab 18 preferably includes a generally upwardly facing surface 18*a* and a slanted, radially inward facing surface 18*b*.

Another aspect of the present invention is the optional provision of warnings and/or instructions 28 for opening and closing the closure printed or molded between the inner edge 14 and the outer edge 12 of the open top wall 26 of the outer cap. (See FIG. 1D). Another aspect of the present invention is the provision of warnings and/or instructions additionally printed or molded on the closed top wall 42 of the inner cap 40, at the radial portion 42*a* (demarcated by the dotted line in FIG. 2D) of the closed top wall 42 masked by the open top wall 26 of the outer cap when the outer cap is mounted on the inner cap, that is, the closure is employed in its child resistant mode. In this way, the closure embodies at least two sets of warnings and/or instructions, with only one set, appropriate for the mode of use, visible at all times. For instance, to comply with CPSC requirements, the masked portion of the closed top wall 42 of the inner cap 40 may include a warning, for example "CAUTION NOT CHILD RESISTANT" or "NOT CHILD-PROOF". Both the inner and outer cap may be made of any suitable material known in the art. Preferably the inner cap is made of transparent material allowing a disc-shaped liner printed with instructions and/or warnings to be mounted or otherwise placed adjacent the lower face 42*b* of the closed top wall 42 of the inner cap, with the aforementioned warning printed adjacent to its outer periphery to be visible through the transparent inner cap.

Figure 2C:
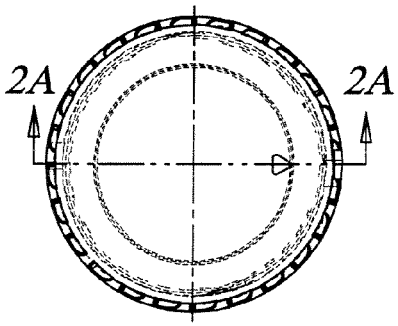
FIG. 2C illustrates a top view of the inner cap.
Figure 2B:
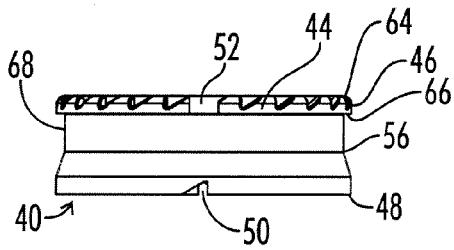
FIG. 2B illustrates a side view of the inner cap.
Figure 2A:
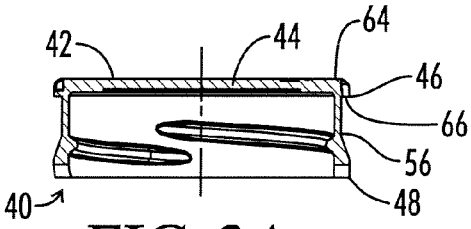
FIG. 2A illustrates a sectional view of the inner cap taken along the line A—A of FIG. 2C.
Figure 2F:
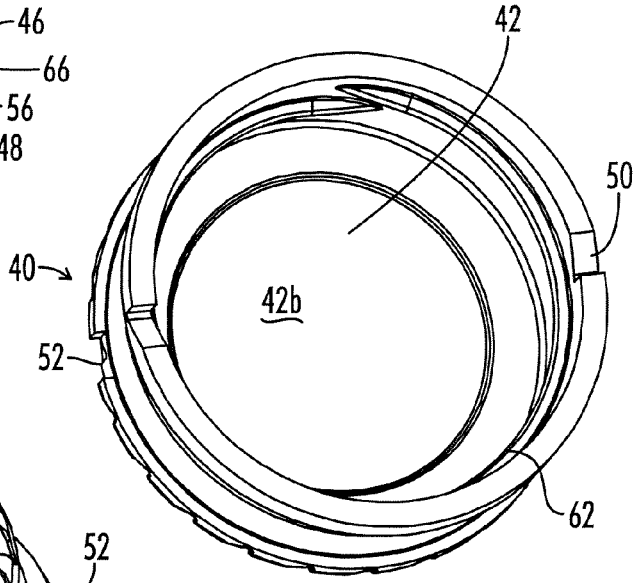
FIG. 2F illustrates a perspective view of the inner cap from the inside of the cap.
Figure 2D:
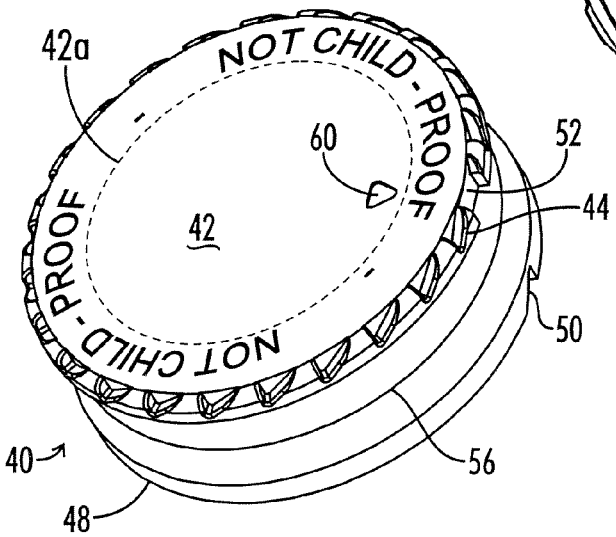
FIG. 2D illustrates a side and top perspective view of the inner cap.
Figure 2E:
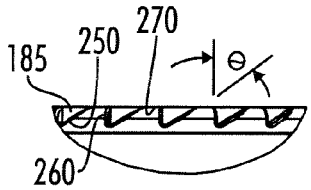
FIG. 2E illustrates a conceptual representation of a row of angular abutments on the interior edge of the inner cap.

As shown in FIG. 2E, the angular abutments 44 of the inner cap 40 are preferably in the form of angular teeth 185, each tooth having a first sloped surface 250 and a second substantially vertical surface 260. The first sloped surface 250 and the substantially vertical surface 260 define an angle θ preferably ranging from about 22° to about 45°, and more preferably about 25° to about 33°. Each tooth may abut directly with the next, or may be spaced apart by surface 270. The inner cap 40 may have any suitable numbers of such sloped first surfaces 250. In the preferred embodiment, the ratio of the teeth of the inner cap to the teeth of the outer cap is one to one. However, any other ratio may be used, including integer and non-integer ratios. In a more preferred embodiment, thirty six (36) sloped surfaces 250 are used which compliment thirty six (36) teeth 85 of the preferred outer cap 10.

The angular abutments 20 on the outer cap 10 are angled in the same direction as the series of angular abutments 44 extending from the top edge 64 of the first circumferential sidewall 68 of the inner cap. Further, angles Ø and θ defined by the abutments of the outer cap 10 and the inner cap 40, respectively, are preferably close to each other. Thus, when the closure 100 is in its child resistant mode as shown in FIG. 4D, and when the outer cap 10 is rotated in the opening direction, the abutment surfaces 150 of the outer cap 10 will ratchet or ride over the angular abutment surfaces 250 of the inner cap 40, thereby permitting rotation of the outer cap 10 relative to the inner cap 40. This, however, can be overcome by the application of a downward axial force on the outer cap 10 toward the inner cap 40 in combination with rotation of the outer cap 10 in the opening direction, which prevents the ratcheting of the angular abutment surfaces of the outer cap 10 over the angular abutment surfaces of the inner cap 40, which in turn causes the inner cap 40 to push and rotate with the outer cap 10 in the opening direction. However, because of the positive lock mechanism between the inner cap and the container, described above, a threshold amount of torque must first be reached to disengage the positive lock mechanism before rotatably removing the closure 100 from the container 70.

To convert the closure 100 from its child resistant mode to its non-child resistant mode simply requires the user to line up the alignment markers 60 and 16 which causes the outer cap retaining tabs 18 to be lined up with the shelling channels 52, purposely ease the outer cap up, causing the tab(s) to exit the groove 56 through the channel(s) 52, leaving a stand-alone non-child resistant cap (the inner cap) incorporating a positive lock mechanism. A reversal of this process of shelling is required to convert the closure from a non-child resistant mode to a child resistant mode. Removal (shelling) of the outer cap from the inner cap also removes the instructions on the outer cap from the closure, and reveals or unmasks the markings or warnings on the inner cap.

In order to utilize a preferred embodiment of the closure 100 when in a child resistant mode, as shown in FIG. 4D, the closure 100 is first placed on the threaded neck portion 80 of the container 70 by threadedly engaging thread 62 of inner cap 40 with the threaded neck portion 80. A rotative force (e.g., clockwise) turns the outer cap 10 in the closing direction. The substantially vertical surfaces 160 of the teeth on the outer cap 10 and substantially vertical surfaces 260 on the inner cap 40 engage to cause the inner and outer caps to turn together, e.g., to cause the inner cap 40 to remain rotationally stationary relative to the outer cap 10, while the outer and inner caps rotate relative to the container to close the container. Upon further rotation of the closure further in the closing direction, the positive lock mechanism engages with a detectable lateral bias to positively lock the closure to the container.

Rotation of the closure 100 in the opposite, e.g., counterclockwise direction will cause the sloped first surfaces 150 of the outer cap 10 to ratchet or ride over the first sloped surfaces 250 of the teeth of the inner cap 40. That is to say, the mere turning of the outer cap 10 in the opening direction will not rotate inner cap 40 in an opening direction because there is no transmission of torque from the outer to the inner cap as the sloped first surfaces 150 ride over and slide by the sloped first surfaces 250. In order to open the closed container 70 with closure 100 in its child resistant mode, the user must utilize both a rotative and a sufficient axial force. It is the axial force that prevents the sloped first surfaces 150 of the outer cap 10 from ratcheting or riding up and over sloped first surfaces 250 of the inner cap 40, at least in part because of the frictional force it generates between the two surfaces. Thus, when the outer cap 10 is rotated in an opening direction, here counterclockwise, with the use of both rotational and axial force, the sloped first surfaces 150 of the outer cap 10 are prevented from ratcheting over sloped first surfaces 250, but instead engage one another to transmit torque between the sloped first surfaces 150 and the sloped first surfaces 250 to thereby rotate the inner cap 40, causing it to deflect the lock mechanism 74 and disengage from the threaded neck portion 80 of the container 70.

The orientation of the tab(s) 18 relative to the marker(s) 16, and therefore the orientation of the marker(s) 60 relative to the channel 52, can be any orientation which lines up one of the tab(s) 18 with the channel 52 when the markers 16, 60 are aligned. Thus, while the drawings illustrate a particular mutual orientation of these features, any other orientation which aligns the tabs and channels is also within the scope of the present invention.

Turning back to FIGS. 3A–3D, the tab(s) 74 preferably includes an upwardly extending, tooth-shaped detent 82 which is sized and configured to be received in the notch(es) 50 of the inner cap 40. The tab(s) 74 can be deformed away from the flange 72 by providing a cutout 84 that extends circumferentially behind the tab 74 and the detent 82, thus causing the tab 74 to be cantilevered. Another aspect of the present invention (not illustrated) includes that the detent 82 can be formed on a portion of the flange 72 which is made more flexible than other portions of the flange, e.g., by reduction in the thickness of that portion of the flange on which the detent 82 is provided. In this manner, the detent 82 can deflect downward by deformation of the flange 72. Yet another aspect of the present invention includes that the detent 82 can be formed on a finger or tab, similar to tab 74, which extends radially from the outer surface of the neck portion 80 of the container; in this manner, the flange 72 is optional and can be eliminated.

Another aspect of the present invention is that the channel(s) 52 and the tab(s) 18 can be reversed, that is, the channel(s) can be provided on the inner surface of the outer cap, and the tab(s) can be provided on the outer surface of the inner cap.

The foregoing is merely describes a presently preferred form for effecting the child resistant feature of the present invention, Of course, other devices or elements for drivingly connecting the inner and outer caps relative to one another may be employed without departing from this invention. See for example, U.S. Pat. No. 5,579,934 for suitable non-limiting alternatives.

Whether in the child resistant mode or in the non-child resistant mode, it is important to impose a minimal torque threshold to permit opening of the containers. This minimal torque threshold could serve as a barrier, even in the non-child resistant mode, or in situations where the closure has become shelled thereby disabling the child resistant means, to toddlers and highly susceptible infants gaining easy access to the contents of the container. One way to impose this barrier is by the incorporation of the positive lock mechanism mentioned above. Thus, a properly designed positive lock mechanism—one that imposes a threshold of torque to disengage the complete closure indicator before rotatably removing the closure from the container—could serve both as a complete closure indicator and a secondary barrier in cases where the child resistant mechanism has failed.

It is to be understood that the shellable child resistant enclosure with positive lock mechanism provided in accordance with the present invention can be formed of any suitable material such as plastic or metal or a combination of materials and the like and that the invention is not intended to be limited by the material from which the devices are formed.

It will be apparent to those skilled in the art that various modifications and variations can be made to the closure of the present invention without departing from the spirit or scope of the invention. Thus, it is intended that the present invention cover the modifications and variations of this invention provided they come within the scope of the appended claims and their equivalents. Accordingly, the invention is not limited by the embodiments described above which are presented as examples only but can be modified in various ways within the scope of protection defined by the appended patent claims.

What is claimed is:

1. A shellable closure for a container includes an inner cap and an outer cap designed to be nested for a child resistant mode and purposefully shellable for use in a non-child resistant mode;

the inner cap and the outer cap each have a row of angular abutments;

the inner cap is coaxially positioned and nested within the outer cap such that the row of angular abutments of the inner cap engage the row of angular abutments of the outer cap upon rotation of the outer cap in a closing direction, and upon rotation of the outer cap in an opening direction, without a concomitant axial force, the respective angular abutments cam over and past each other to prevent rotation of the inner cap;

said outer cap has at least two tabs and said inner cap has a groove and at least one channel, said tabs being spaced about the outer cap and fitted in said groove;

said tabs shaped to hold said outer cap in nesting relation to said inner cap when said tabs are fitted in said groove;

said channel being shaped to allow one of said tabs to pass through said channel whereby when one of said tabs and said channel are aligned, said outer cap can be easily removed from its nesting relationship relative to said inner cap.

2. The shellable closure of claim 1 wherein there are at least three tabs and one channel.

3. The shellable closure of claim 1 wherein said inner cap and said outer cap are round when viewed from the top of the closure, and wherein said inner cap includes words indicating that the cap is not child proof, with said words being viewable only when said outer cap is removed from said inner cap.

4. The shellable closure of claim 1 in combination with a container having a neck, the inner cap having a positive locking device for engagement with a complementary locking device on the neck of the container.

5. A closure system for a container having a neck with an engaging device, said closure system including:

a. a cap having a top wall with an upper, outside surface and a circumferential side wall depending from said top wall, said side wall having an inside surface and an outside surface;

b. an engaging device on the inside surface of said side wall for cooperatively engaging an engaging device on a container;

c. a series of angular abutments on said cap designed to allow a cam follower to cam over said abutments when a cam follower is moved in one direction and to engage a cam follower moved in another direction;

d. a groove in said outside surface of said circumferential side wall, and e. a channel in said outside surface of said circumferential side wall, said channel running from said groove to the upper, outside surface of the top of said cap;

whereby said cap can serve as a non-childproof closure for a container, but can be made childproof by the addition of a second cap to the closure system.

6. The closure system of claim 5 wherein said engaging device is a helical thread.

7. The closure system of claim 5 wherein said angular abutments are saw-tooth shaped.

8. The closure system of claim 5 wherein said series of angular abutments are on the outer surface of the circumferential sidewall adjacent the upper, outer surface of said top wall.

9. The closure system of claim 8 wherein said channel passes through said series of angular abutments.

10. The closure system of claim 5 wherein said channel passes substantially axially along said outside surface of said circumferential sidewall of said cap.

11. The closure system of claim 5 wherein said grove has a cross sectional shape with a surface substantially perpendicular to the outside surface of said circumstantial sidewall and another surface tapered from said outside surface of said circumferential sidewall.

12. The closure system of claim 11 where said perpendicular surface is closer to said upper, outside surface of said top wall than said tapered surface.

13. The closure system of claim 5 further including a second cap sized and shaped to fit over, and nest about, the cap of claim 5, said second cap including:

a. a top wall;

b. a circumferential sidewall depending from said top wall, said circumferential sidewall having an inside surface and outside surface;

c. a series of angular abutments on the inside surface of said circumferential sidewall, said angular abutments designed to serve as cam followers for cooperative engagement with the series of angular abutments on the cap of claim 5;

d. at least two tabs on the inner surface of said circumferential 1 sidewall, said tabs design shaped and positioned to engage the grove of the cap of claim 5 when the second cap is placed in nesting relationship over the cap of claim 5; and e. Said tabs each shaped to pass through said channel when one of said tabs is aligned with said channel.

14. The closure system of the claim 13 wherein, when said second cap nested over the cap of claim 5, said second cap can move axially relative to the cap of claim 5 a distance sufficient to allow the angular abutments of said second cap to cam over the abutments of the cap of claim 5 when said second cap is moved in an opening direction but will engage the angular abutments of the cap of claim 5 to cause movement of the cap of claim 5 when said second cap is moved in a closing direction.

15. The closure system of claim 14 wherein the angular abutments of the two caps engage and cause the cap of claim 5 to move in an opening direction when said second cap is moved in an opening direction if axially force is applied to said second cap pushing it in the direction of cap of claim 5.

16. The closure system of claim 13 including three tabs on the inner surface of said circumferential sidewall.

17. The closure system of claim 13 wherein said tabs are tapered and have a cross sectional shape generally shaped to mate with the cross sectional shape of said groove.

18. The closure system of claim 5 wherein said circumferential sidewall includes a first end attached to said top wall and a second, free end terminating the circumferential sidewall, and at least one notch in said second end.

19. The closure system of claim 18 further including a container having a neck with a flange extending circumferentially about the neck of said container, said flange including at least on laterally displaceable tab that snaps into said notch when said cap is moved in a closing direction over said container.

20. The closure system of claim 19 wherein there are two tabs and two notches spaced diametrically opposed from each other on said second end and said flange, respectfully.

21. The closure system of claim 19 wherein said tab and notch each have a ramping surface and an abutment surface so that when said cap is rotated in a closing direction, the abutment surfaces will engage and limit the movement of the cap in the closing direction.

22. The closure system of claim 21 wherein said ramping surfaces allow said cap to move in an opening direction relative to said container when the ramping surface of said notch ramps over the ramping surface of said tab.

23. The closure system of claim 22 wherein said flange includes a cantilevered section with the tab on the end of the cantilevered section so that the tab can move laterally in response to pressure.

24. A cap for use in conjunction with a closure system for a container and designed to make the closure system child proof, said cap including:

a. a top wall having an outer top surface and an inner underside surface;

b. a circumferential sidewall depending from said top wall, said circumferential sidewall having an inside surface and outside surface;

c. a series of angular abutments on said underside surface of said top wall, said angular abutments designed to serve as cam followers for cooperative engagement with a series of angular abutments on a closure cap;

d. at least two tabs on the inner surface of said circumferential sidewall, said tabs designed, shaped and positioned to engage a grove in the closure cap when said cap is placed in nesting relationship over the outside of the closure cap; and e. said tabs shaped to pass through a channel in the closure cap when one of said tabs is aligned with such a channel and allow separation of said cap relative to the closure cap.

* * * * *